US006969924B2

(12) United States Patent
Hisamoto

(10) Patent No.: US 6,969,924 B2
(45) Date of Patent: Nov. 29, 2005

(54) STARTER CONTROL APPARATUS

(75) Inventor: Motoi Hisamoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 45 days.

(21) Appl. No.: 10/782,864

(22) Filed: Feb. 23, 2004

(65) Prior Publication Data

US 2005/0184525 A1 Aug. 25, 2005

(51) Int. Cl.[7] ..... F02N 11/00
(52) U.S. Cl. ..... 290/38 R; 290/38 C; 74/6
(58) Field of Search ..... 290/30 R, 31, 290/36 R, 38 R, 38 C; 74/6

(56) References Cited

U.S. PATENT DOCUMENTS 4,900,945 A * 2/1990 Isozumi et al. ..... 290/48
4,917,410 A * 4/1990 Cummins et al. ..... 290/38 R
5,001,412 A * 3/1991 Carter et al. ..... 322/10
5,239,954 A * 8/1993 Boegner et al. ..... 123/179.3
5,595,257 A * 1/1997 Yoshida et al. ..... 180/287
5,909,067 A * 6/1999 Liadakis ..... 310/14
6,049,263 A * 4/2000 Vilou ..... 335/126
6,525,430 B1 * 2/2003 Asai et al. ..... 290/1 A
6,759,756 B2 * 7/2004 Shiga et al. ..... 290/38 R

FOREIGN PATENT DOCUMENTS

JP 2000-087831 3/2000

* cited by examiner

*Primary Examiner*—Nicholas Ponomarenko
(74) *Attorney, Agent, or Firm*—Sughrue Mion, PLLC

(57) ABSTRACT

There is provided a starter control apparatus including a control circuit board which can reduce the number of parts and prevents erroneous fitting. An earth pattern is formed in the vicinity of an attachment hole of the control circuit board and only on a one surface, positions of attachment holes of the control circuit board provided in a case and a cap are made different from each other between a case where an earth system is body earth and a case where it is earth float, and the respective positions are made symmetrical positions with respect to the attachment position center line of the control circuit board, so that fitting is enabled only when the control circuit board is put face-up in the case of the body earth type and only when it is put face-down in the case of the earth float type.

8 Claims, 3 Drawing Sheets

STARTER CONTROL APPARATUS

BACKGROUND OF THE INVENTION

1. Field of the Invention

The present invention relates to a control apparatus for controlling an engage switch of a starter for starting an internal combustion engine, and particularly to a structure of a starter relay having a control circuit board.

2. Description of Related Art

A starter for starting an internal combustion engine is provided with an engage switch including a main switch and a pinion transfer mechanism, and a starter relay for performing ON/OFF control of a power supply to the engage switch. The supply of power to the starter relay includes two types according to a circuit structure of a system, in which an earth system is a body earth type and is an earth float type.

In recent years, control for various safeties and parts protection is introduced into a vehicle, and a control circuit board for protection is provided also in a start circuit of a starter, and this control circuit board is generally provided in a starter relay (see, for example, patent document 1: JP-A-2000-87831 (page 3, FIG. 6)). Also with respect to the starter relay provided with the control circuit board as stated above (since the starter relay includes the control circuit, it will be referred to as the starter control apparatus), it becomes necessary to properly use the body earth type and the earth float type depending on a circuit structure.

The patent document 1 discloses that a control circuit board (protection circuit in the patent document 1) is incorporated in the inside of a cap having a terminal of a starter control apparatus (auxiliary switch in the patent document 1), and such structure is effective in miniaturization.

In the case where the control circuit board is provided in the inside of the starter control apparatus, it is concurrently fastened by a screw to attach a cap to a case for miniaturization and simplification of the structure. In the control circuit board of the body earth type, an earth pattern is provided in a thread fastening portion, so that the connection of the earth is performed at the same time as the screw fixation of the control circuit board, and on the other hand, in the control circuit board of the earth float type, a land for the earth is not provided at the thread fastening portion, so that both are properly used. However, although both have the same circuit content except for the existence of the land for the earth, two kinds of control circuit boards are required for setting the body earth type and the earth float type, and there are problems that the number of parts is increased, and erroneous fitting is performed since discrimination between both is difficult.

SUMMARY OF THE INVENTION

The invention has been made to solve the problems as stated above, and an object thereof is to provide a starter control apparatus including a control circuit board, in which the control circuit board is used for both body earth and earth float, so that the number of parts can be reduced and erroneous fitting can be prevented.

A starter control apparatus of the invention includes a conductive case for housing an exciting coil, a cap made of an insulating member and attached to close an open end of the case, and a control circuit board on which a control circuit is mounted and which, together with the cap, is attached to the case through the cap and is fixed by a conductive attachment screw, wherein an earth pattern is formed in a vicinity of an attachment hole of a one surface of the control circuit board, and an earth system of the apparatus is properly used for both types of body earth and earth float by changing an attachment direction.

DETAILED DESCRIPTION OF THE INVENTION

Embodiment 1

Figure 1B:
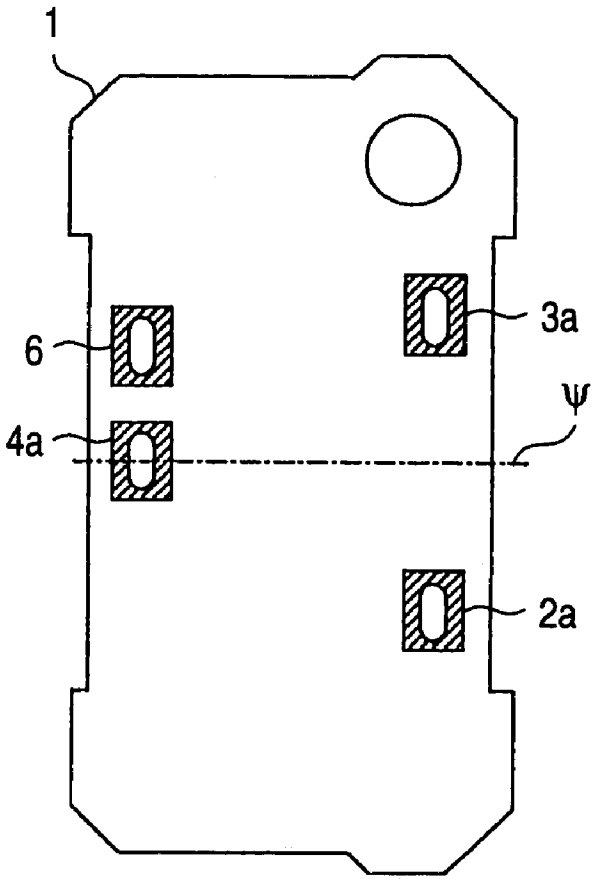
FIGS. 1A and 1B are principal structure views of a control circuit board used for a starter control apparatus according to embodiment 1 of the invention.
Figure 1A:
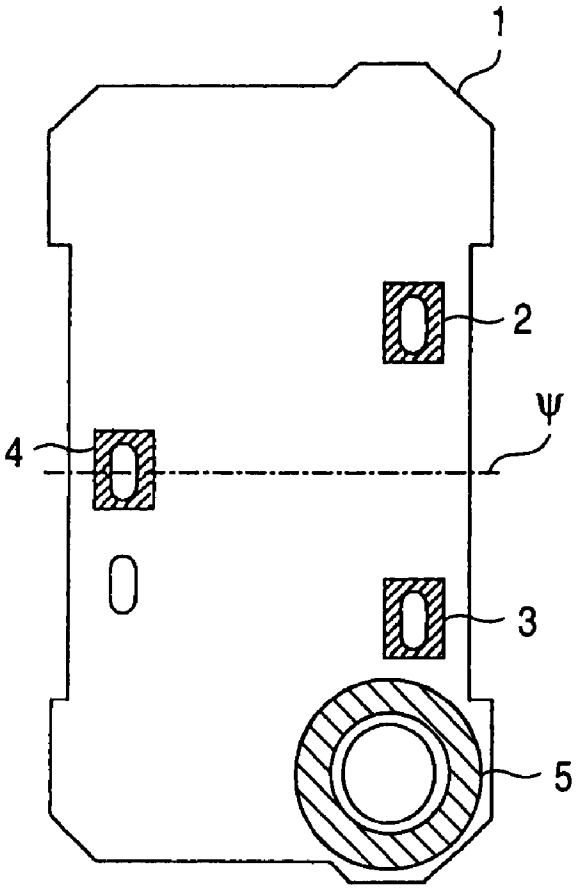
Figure 2A:
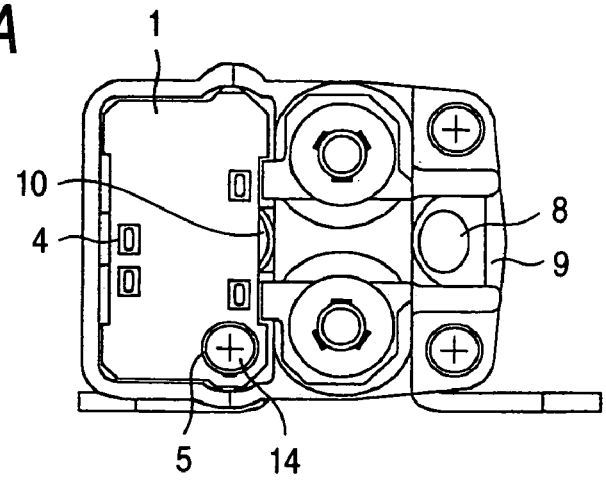
FIGS. 2A to 2C are structure views of the starter control apparatus of a body earth type according to the embodiment 1 of the invention.
Figure 2B:
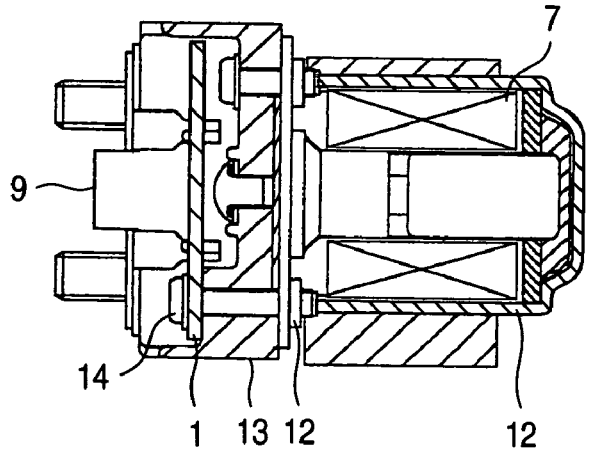
Figure 2C:
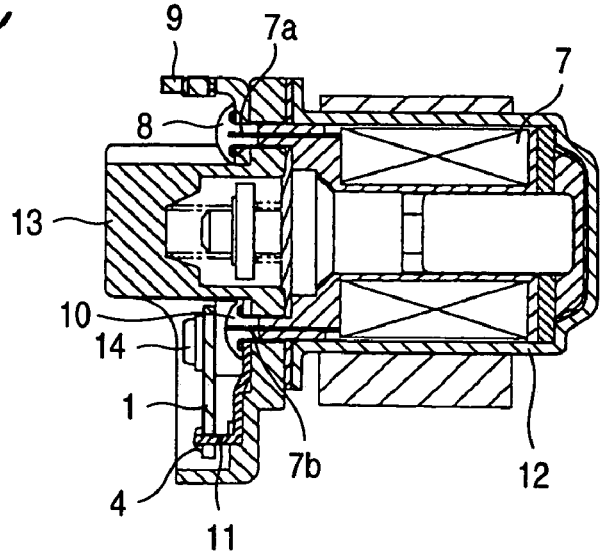
Figure 3A:
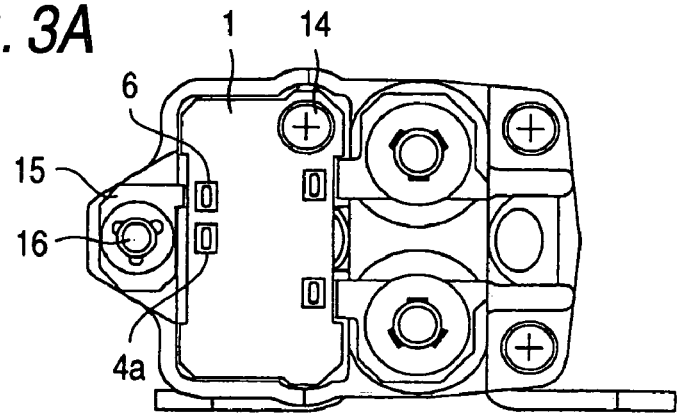
FIGS. 3A to 3C are structure views of the starter control apparatus of an earth float type according to the embodiment 1 of the invention.
Figure 3B:
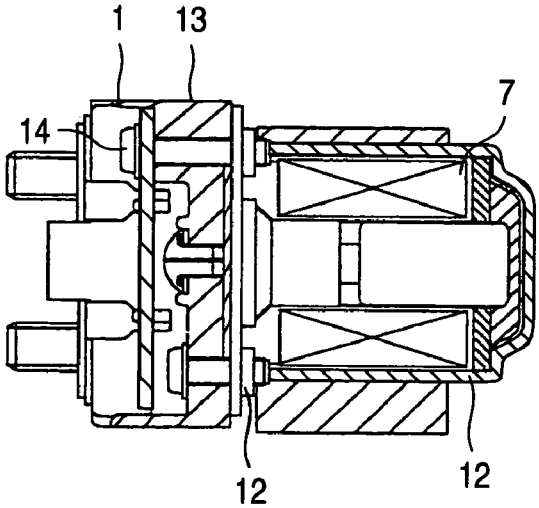
Figure 3C:
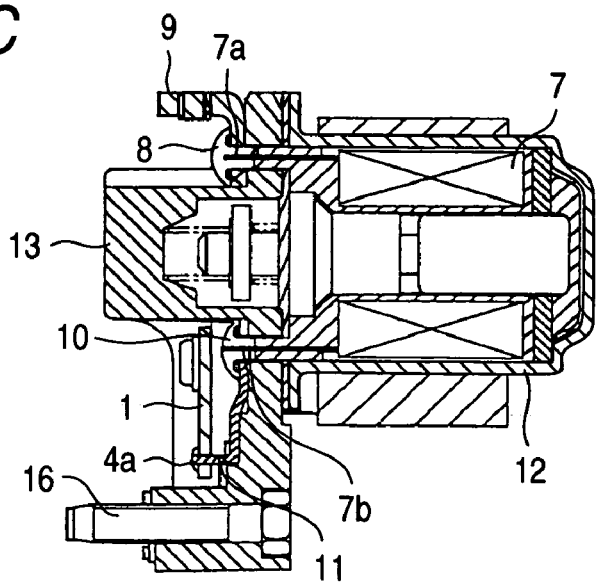

FIGS. 1A to 3C are for explaining the structure of a starter control apparatus according to embodiment 1 of the invention, and FIGS. 1A and 1B show the principal structure of a control circuit board used for the starter control apparatus, in which FIG. 1A shows a one surface and FIG. 1B shows the other surface. FIGS. 2A to 2C shows a structure in a case where the control circuit board of FIG. 1 is used for the starter control apparatus of a body earth type, in which FIG. 2A is a front view, FIG. 2B is a sectional view, and FIG. 2C is a sectional view of a section different from FIG. 2B by 90°. FIGS. 3A to 3C show a structure in a case where the control circuit board of FIG. 1 is used for the starter relay of an earth float type, in which FIG. 3A is a front view, FIG. 3B is a sectional view, and FIG. 3C is a sectional view of a section different from FIG. 3B by 90°.

As shown in FIG. 1A, a power terminal pattern (B terminal pattern) 2, a C terminal pattern 3 at a symmetrical position with respect to the power terminal pattern 2 and connected to the power terminal pattern 2, an L terminal pattern 4 connected to an after-mentioned exciting coil of the starter control apparatus, and an earth pattern (E terminal pattern) 5 provided at a portion with which a bearing surface of an attachment screw comes in contact at a time of fitting are formed on the one surface of the control circuit board 1, and although not shown, parts for constituting a circuit are mounted on the control circuit board 1. Hereinafter, the surface of the circuit board 1 at this side is referred to as a "a" surface, and the surface at the other side is referred to as a "b" surface.

On the "b" surface as the other surface of the control circuit board 1, a same B terminal pattern 2*a* is formed at a back portion of the power terminal pattern 2 of the "a" surface, a same C terminal pattern 3*a* is formed at a back portion of the C terminal pattern 3 of the "a" surface, a same L terminal pattern 4*a* is formed at a back portion of the L terminal pattern 4 of the "a" surface, and an e terminal pattern 6 as an earth connection pattern on the control circuit board 1 is formed. The outer shape and the positions of the B terminal pattern 2 and the C terminal pattern 3 are formed to be symmetrical with respect to a center line Ψ in the vertical direction of FIGS. 1A and 1B.

In the starter control apparatus of the body earth type in which the control circuit board 1 is mounted as shown in FIGS. 2A to 2C, a one winding end 7*a* of an exciting coil 7 is led out to the outside through an eyelet 8 and a terminal 9, and is connected to, for example, a key switch or the like of a vehicle. The other winding end 7*b* of the exciting coil 7 is connected to the L terminal pattern 4 of the control circuit board 1 through an eyelet 10 and a connection connector 11. When a cap 13 is fitted to close an opening end of a case 12, the control circuit board 1, together with the cap 13, is fixed to the case 12 by an attachment screw 14, and is attached so that the "a" surface is positioned at a head side of the attachment screw 14, and therefore, the E terminal pattern 5 is electrically connected to the case 12 through the attachment screw 14 and forms the body earth.

In the starter control apparatus of the earth float type including the control circuit board 1 as shown in FIGS. 3A to 3C, similarly to the case of the body earth type, when the cap 13 is fitted to close the opening end of the case 12, the circuit board 1, together with the cap 13, is fixed to the case 12 by the attachment screw 14. However, as shown in the drawing, a screw seat for the attachment screw 14 is, as compared with the case of FIGS. 2A to 2C, provided at a symmetrical position with respect to the center line of the attachment position of the control circuit board 1. Accordingly, unless the control circuit board 1 is not turned over, it can not be attached.

Besides, also in the starter control apparatus of the earth float type, the one winding end 7*a* of the exciting coil 7 is lead out to the outside through the eyelet 8 and the terminal 9, and is connected to, for example, the key switch or the like of the vehicle, and the other winding end 7*b* of the exciting coil 7 is connected to the L terminal pattern 4*a* of the control circuit board 1 through the eyelet 10 and the connection connector 11.

When the cap 13 is fitted to the case 12, the control circuit board 1, together with the cap 13, is fixed to the case 12 by the attachment screw 14. However, as described above, since the control circuit board 1 can not be attached unless it is turned over, the E terminal pattern 5 of the control circuit board 1 comes in contact with the cap 13 made of the insulating member and is not body earthed to the case 12, and instead thereof, as shown in FIG. 3A, the e terminal pattern 6 is electrically connected to an earth lead bolt 16 through the connection connector 15 and is led out.

By the construction as stated above, the control circuit board 1 of one kind can be properly used for both the starter relay of the body earth type and the starter relay of the earth float type, so that the number of parts can be reduced, and further, since the control circuit board 1 can not be fitted to the starter control apparatus of a different earth system unless it is turned over, erroneous fitting is not caused. Incidentally, since the cap 13 can not be originally used for both from its structure, it does not increase the number of parts according to this structure.

In the starter control apparatus constructed as described above, according to an aspect of the invention, there are provided the insulating cap attached to close the open end of the conductive case, and the control circuit board on which the control circuit is mounted and which is attached to the case through the cap and is fixed by the conductive attachment screw, wherein the earth pattern is formed in the vicinity of the attachment hole of the one surface of the control circuit board, and the earth system of the apparatus is properly used for both types of the body earth and the earth float by changing the attachment direction. Accordingly, the control circuit board of one kind can be properly used for the starter control apparatuses of both types of the body earth and the earth float, and the number of parts can be reduced, that is, standardization becomes possible, and erroneous fitting can be prevented.

What is claimed is:

1. A starter control apparatus, comprising:

a conductive case for housing an exciting coil;

a cap made of an insulating member and attached an open end of the case to close the open end;

a control circuit board, on which a control circuit is mounted, is attached to the case through the cap and is fixed by a conductive attachment screw, and an earth pattern formed in a vicinity of an attachment hole of a first surface of the control circuit board, wherein, an earth system of the starter control apparatus is properly used for a body earth system and an earth float system, respectively, by changing an attachment direction of the control circuit board.

2. The starter control apparatus according to claim 1, wherein when the earth system is the body earth system, the attachment direction is set so that the earth pattern is positioned at a head side of the attachment screw.

3. The starter control apparatus according to claim 1, wherein when the earth system is the earth float system, the attachment direction is set so that the earth pattern is positioned at a side of the cap.

4. The starter control apparatus according to claim 3, wherein an earth connection pattern is provided on a second surface of the control circuit board, and at a portion other than the vicinity of the attachment hole, wherein, when the earth system is the earth float system, an earth terminal is led out of the starter control apparatus via the earth connection pattern.

5. The starter control apparatus according to claim 1, wherein an attachment screw hole for the control circuit board and an attachment hole in the case and the cap are provided at different positions when the earth system is the body earth system compared to when the earth system is the earth float system, and the respective positions are symmetrical with respect to an attachment position center line of the control circuit board.

6. The starter control apparatus according to claim 2, wherein an attachment screw hole for the control circuit board and an attachment hole in the case and the cap are provided at different positions when the earth system is the body earth system compared to when the earth system is the earth float system, and the respective positions are symmetrical with respect to an attachment position center line of the control circuit board.

7. The starter control apparatus according to claim 3, wherein an attachment screw hole for the control circuit board and an attachment hole in the case and the cap are provided at different positions when the earth system is the body earth system compared to when the earth system is the earth float system, and the respective positions are symmetrical with respect to an attachment position center line of the control circuit board.

8. The starter control apparatus according to claim 4, wherein an attachment screw hole for the control circuit board and an attachment hole in the case and the cap are provided at different positions when the earth system is the body earth system compared to when the earth system is the earth float system, and the respective positions are symmetrical with respect to an attachment position center line of the control circuit board.

* * * * *